US008206879B2

(12) United States Patent
Izutani et al.

(10) Patent No.: US 8,206,879 B2
(45) Date of Patent: Jun. 26, 2012

(54) IMAGE FORMING METHOD

(75) Inventors: Akira Izutani, Takatsuki (JP); Minoru Nakamura, Takarazuka (JP)

(73) Assignee: Ricoh Company, Ltd., Tokyo (JP)

( * ) Notice: Subject to any disclaimer, the term of this patent is extended or adjusted under 35 U.S.C. 154(b) by 733 days.

(21) Appl. No.: 12/050,663

(22) Filed: Mar. 18, 2008

(65) Prior Publication Data

US 2008/0232849 A1 Sep. 25, 2008

(30) Foreign Application Priority Data

Mar. 19, 2007 (JP) ..... 2007-071535
Dec. 10, 2007 (JP) ..... 2007-318528

(51) Int. Cl.
*G03G 15/01* (2006.01)

(52) U.S. Cl. ..... 430/45.51; 399/299; 399/302; 430/125.3; 430/111.4; 430/47.1; 430/47.2

(58) Field of Classification Search ..... 430/45.51, 430/125.3, 111.4, 47.1, 47.2; 399/299, 302
See application file for complete search history.

(56) References Cited

U.S. PATENT DOCUMENTS 5,774,771 A * 6/1998 Kukimoto et al. ..... 430/45.54
6,087,056 A * 7/2000 Toyoshima et al. ..... 430/120.1
6,284,424 B1 * 9/2001 Iimura et al. ..... 430/123.41
7,704,660 B2 * 4/2010 Kashiwabara et al. .... 430/111.4
2001/0033984 A1 * 10/2001 Matsumura et al. ..... 430/111.4
2003/0077535 A1 * 4/2003 Schein et al. ..... 430/111.4
2003/0152856 A1 * 8/2003 Mizoe et al. ..... 430/108.1
2006/0024604 A1 * 2/2006 Sugiura et al. ..... 430/111.4
2006/0204882 A1 9/2006 Nozaki et al.
2006/0210902 A1 9/2006 Nakamura et al.
2006/0275686 A1 12/2006 Kadota et al.
2007/0059625 A1 3/2007 Yamamoto et al.
2007/0166635 A1 7/2007 Yamamoto et al.
2007/0178398 A1 * 8/2007 Ogino et al. ..... 430/111.4

(Continued)

FOREIGN PATENT DOCUMENTS

JP 2005-31120 2/2005

(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 164-168.*

*Primary Examiner* — Christopher Rodee
(74) *Attorney, Agent, or Firm* — Oblon, Spivak, McClelland, Maier & Neustadt, L.L.P.

(57) ABSTRACT

To provide an image forming method for obtaining excellent image quality under high humidity. The image forming method including charging a surface of a latent electrostatic image bearing member, exposing the charged surface of the latent electrostatic image bearing member so as to form a latent electrostatic image, developing the latent electrostatic image using a developer so as to form a toner image, and transferring the toner image from the latent electrostatic image bearing member to a transfer medium, wherein in the developing step, a toner is used that has an interparticle adhesion force of 500 nN to 1,200 nN when pressed at 500 nN and a volume average particle diameter of 4 μm to 8 μm, and in the transferring step, the transfer pressure applied to the transfer medium is 20 N/m to 60 N/m, and wherein a tandem image forming apparatus is used in the image forming method.

7 Claims, 6 Drawing Sheets

U.S. PATENT DOCUMENTS

| | | | |
|---|---|---|---|
| 2007/0190442 | A1 | 8/2007 | Nakamura et al. |
| 2007/0207399 | A1 | 9/2007 | Kadota et al. |
| 2007/0218384 | A1 | 9/2007 | Matsumoto et al. |
| 2007/0218393 | A1 | 9/2007 | Nozaki et al. |
| 2008/0038656 | A1 | 2/2008 | Yasunaga et al. |

FOREIGN PATENT DOCUMENTS

| | | |
|---|---|---|
| JP | 2005-338232 | 12/2005 |
| JP | 2006-98964 | 4/2006 |
| JP | 2006-145805 | 6/2006 |

* cited by examiner

IMAGE FORMING METHOD

BACKGROUND OF THE INVENTION

1. Field of the Invention

The present invention relates to an image forming method using an image forming apparatus for an electrophotographic process, such as copiers, facsimiles and printers.

2. Description of the Related Art

Conventionally, in an image forming method for full-color electrophotography in a tandem system, colors are superimposed on a transfer medium. In the method, the second color toner image is superimposed on the unfixed first color toner image. The unfixed toner extremely unstably adheres to the transfer medium. The second toner image may be out of the predetermined position by a slight external force. Additionally, the second color toner is more unstably adheres to the transfer medium, because it is superimposed on the first color toner. When the toner adhesion to the transfer medium is unstable, the toner reversely transfers to a latent electrostatic image bearing member. As a result, a desired image density or color reproducibility cannot be obtained. Particularly, unstable color reproducibility (reverse transfer toner generation) caused by the unstable condition of the second color toner is a serious problem in a full-color process.

The mechanism of occurrence of the reverse transfer toner has not been elucidated, but generally, the reverse transfer toner is mainly considered to be caused by generation of the toner charged to have the opposite polarity to the normal toner charge polarity (hereinafter, referred to as the reverse polarity toner), the unstable average charge amount of toner, and generation of mechanical disturbing force between a transfer medium and an image bearing member. Specifically, it is considered to be caused by the following reasons: the electrical field causing the toner movement becomes more unstable in the second color toner than in the first color toner, and a toner layer on the transfer medium becomes thicker.

Generally, the charge amount of the toner which is transferred from an image bearing member to a transfer medium is preferably 10 μC/g to 30 μC/g in the absolute value. The charge amount of toner is an average value of the charge amounts of the measured toner, in fact, the charge amounts of toner have a distribution of a certain rang, and some toner particles have an opposite polarity to the normal toner polarity. As the amount of the reverse polarity toner increases, the amount of the reverse transfer toner tends to increase. Thus, a method of making the distribution of charge amount of toner sharp is generally used in order to prevent the increase of the amount of the reverse transfer toner.

Moreover, the larger the amount of toner transferred to the transfer medium, the more frequently reverse transfer occurs. For example, in a tandem system, the toner is more frequently reversely transferred in the image bearing member located in more downstream of the sheet conveyance direction.

For example, in order to reduce the reverse transfer toner, Japanese Patent Application Laid-Open (JP-A) No. 2005-31120 discloses a tandem image forming apparatus in which the reversely charged toner is recovered from the residual toner remaining on a photoconductor drum and retained and then the retained residual toner is returned to the photoconductor drum, wherein the toner used in a developing device which is located on the mostdownstream of a movement direction of an intermediate transfer belt, is adjusted to have the highest dielectric constant. Additionally, JP-A No. 2006-145805 discloses an image forming apparatus having a primary transfer roller configured to transfer a toner image on an intermediate belt, and a secondary transfer roller configured to transfer the toner image retained on the intermediate belt on variously sized recording media, wherein the differences in linear velocity and coefficient of dynamic friction between a photoconductor and the intermediate transfer belt are respectively 7 mm/s or more and 0.03 or more, and the primary transfer roller has a primary transfer pressure of less than 15N/m. Furthermore, JP-A 2005-338232 discloses an image forming apparatus containing a plurality of image forming units each configured to form toner images, and a transfer belt configured to transfer the toner images formed by the image forming units, in which the residual toner in one image forming unit arranged in the upstream of the medium conveying direction of the transfer belt which forms a medium conveying path, is moved onto the transfer belt, and then the moved residual toner is recovered to the other image forming unit arranged in the mostdownstream of the medium conveying direction of the transfer belt.

BRIEF SUMMARY OF THE INVENTION

However, the methods of reducing the reverse transfer toner disclosed in JP-A Nos. 2005-31120 and 2006-145805 do not always reduce the reverse transfer toner under high humidity. The image forming apparatus disclosed in JP-A 2005-338232 causes a problem that colors of toner are mixed in the developing device and adversely affect image quality such as color reproducibility.

An object of the present invention is to solve the above problems by providing an image forming method for obtaining excellent image quality under high humidity.

The feature of the present invention to solve the above problems is as follows:

An image forming method including: charging a surface of a latent electrostatic image bearing member; exposing the charged surface of the latent electrostatic image bearing member so as to form a latent electrostatic image; developing the latent electrostatic image using a developer so as to form a toner image; and transferring the toner image from the latent electrostatic image bearing member to a transfer medium, wherein in the developing step, a toner is used that has an interparticle adhesion force of 500 nN to 1,200 nN when pressed at 500 nN and a volume average particle diameter of 4 μm to 8 μm, and in the transferring step, the transfer pressure applied to the transfer medium is 20 N/m to 60 N/m, and wherein a tandem image forming apparatus is used in the image forming method.

The image forming method according to <1>, wherein particles of the toner are subjected to external additive treatment with inorganic fine particles treated with silicone oil and inorganic fine particles not treated with silicone oil having an average primary particle diameter of 50 nm to 150 nm.

The image forming method according to <2>, wherein the inorganic fine particles contain fine particles selected from silica, alumina, titania and a composite oxide thereof.

The image forming method according to <1>, wherein when the transfer pressure of "n" th color toner is defined as "P(n)", and the transfer pressure of "(n+1)" th color is defined as "P(n+1)", P(n) and P(n+1) satisfy the relation of P(n)>P(n+1) upon transferring the toner image formed on the latent electrostatic image bearing member to the transfer medium.

The image forming method according to <1>, wherein after the toner is transferred to the transfer medium, a residual toner remaining on the latent electrostatic image bearing member is recovered in a developing unit and reused.

The image forming method according to <1>, wherein when the interparticle adhesion force of the toner transferred on the transfer medium as (n) th color is defined as "Ft(n)" and the interparticle adhesion force of the toner transferred on the transfer medium as (n+1)th color is defined as "Ft(n+1)", Ft(n) and Ft(n+1) satisfy the relation of Ft(n)>Ft(n+1).

Thus, an image forming method for obtaining excellent image quality under high humidity can be obtained.

DETAILED DESCRIPTION OF THE INVENTION

Figure 1:
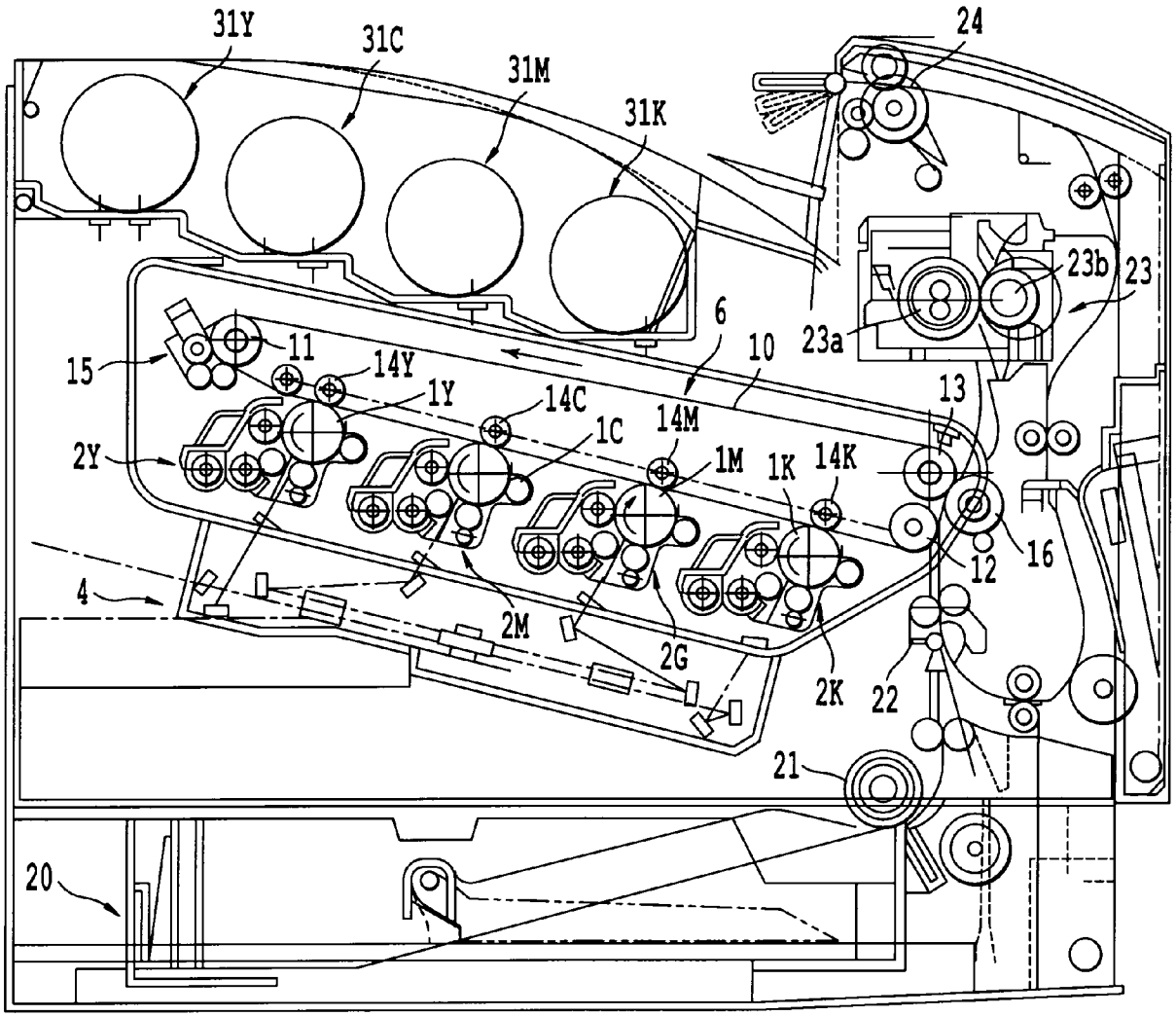
FIG. 1 is a schematic view exemplifying a configuration of an image forming apparatus according to an embodiment of the present invention.

Hereinafter, the best embodiment of the present invention will be described with reference to the drawings. Note that those skilled in the art can easily make other embodiments by changing and modifying the present invention in a range of the scope of claims, and these changes and modifications are included in the scope of claims. The description below is the best embodiment of the present invention, but not intended to limit the scope of claims.

The reverse transfer toner which affects color reproducibility occurs when the second color toner is superimposed on the first color toner layer on a transfer medium. It is considered that an interparticle adhesion force of toners greatly affects occurrence of reverse transfer toner when transferring. As the interparticle adhesion force increases, a toner particle is bound by other toner particles. Thus, regardless of the state of toner charge, the amount of the reverse transfer toner can be decreased.

The interparticle non-electrostatic adhesion force represented by van der Waals force increases when the interparticle spaces become narrow. Generally, inorganic fine particles such as silica are externally added on the surface of toner so as to control flowability, and the spaces are kept constant because the external additive serves as a spacer. Therefore, external force is necessarily applied to narrow the spaces among toner particles.

In order to improve image quality, it is considered to make the diameter of toner particles smaller. The pressure applied to the toner particles when transferring decreases, as the diameter of the toner particles becomes small, as long as the amount of toner conveyance on a latent electrostatic image bearing member is constant. For example, the pressure applied to the toner particles is found from the toner having a volume average particle diameter of 10 μm and the toner having a volume average particle diameter of 5 μm, and the pressure applied to the toner having a volume average particle diameter of 5 μm is one eighth times that applied to the toner having a volume average particle diameter of 10 μm. Therefore, in order to narrow the spaces between toner particles by external force when transferring, the smaller diameters the toner particles have, the higher the transfer pressure to the toner particles is made.

Examples of the methods of increasing interparticle non-electrostatic adhesion force include a method of treating an external additive with silicone oil and a method of giving adhesion by controlling a glass transition temperature Tg of a resin composition of toner base. However, when the external additive treated with silicone oil is used alone, the toner flowability may be decreased in no pressure condition. Thus, in the present invention, inorganic fine particles not treated with silicone oil is used in combination with the external additive treated with silicone oil.

As a result, the interparticle adhesion force of toner particles can be controlled to increase only under pressure. In addition to increasing interparticle non-electrostatic adhesion force by external force such as transfer pressure, by adding an external additive and modifying a toner base surface, the present invention may obtain more preferable effect.

A basic configuration of an image forming apparatus (printer) of the present embodiment will be explained with reference to the drawings.

FIG. 1 is a schematic view showing a configuration of the image forming apparatus according to an embodiment of the present invention. In this instance, a description is given for one embodiment, which is used in an electrophotographic image forming apparatus. The image forming apparatus is to form color images by using four different colors of toner, that is, yellow (hereinafter, abbreviated as "Y"), cyan (hereinafter, abbreviated as "C"), magenta (hereinafter, abbreviated as "M") and black (hereinafter, abbreviated as "K").

First, a description is given for a basic configuration of a tandem image forming apparatus. The image forming apparatus is provided with four photoconductor drums 1Y, 1C, 1M and 1K as latent electrostatic image bearing members. This example mentions a drum-shaped photoconductor but a belt-shaped photoconductor may be also adopted. Each of the photoconductor drums 1Y, 1C, 1M and 1K is rotated and driven in a direction given in the arrow of the drawing while in contact with an intermediate transfer belt 10. Each of the photoconductors 1Y, 1C, 1M, and 1K may be composed of a photosensitive layer formed on a relatively thin cylindrical conductive base and a protective layer formed on the photosensitive layer. Further, an intermediate layer may be formed between the photosensitive layer and the protective layer.

Figure 2:
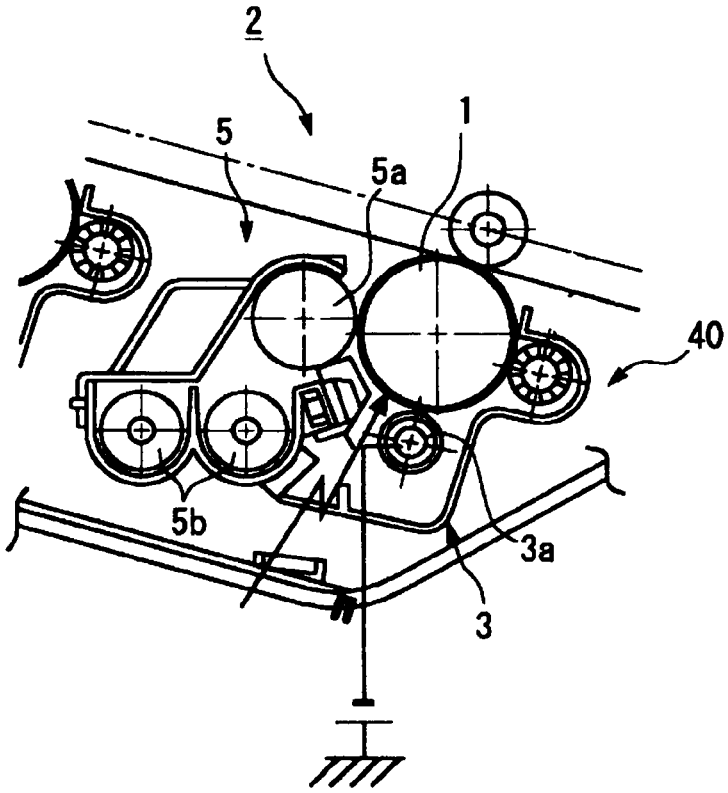
FIG. 2 is a schematic view exemplifying a configuration around a photoconductor drum.

FIG. 2 is a schematic view showing a configuration of an image forming unit 2 at which photoconductor drums are disposed. Since all surroundings of the photoconductor drums, 1Y, 1C, 1M and 1K, at each of the image forming units, 2Y, 2C, 2M and 2K (as shown in FIG. 1), are configured in a similar manner, only one of the image forming units 2 is illustrated and symbols for color identification, Y, C, M, K, are omitted for illustration. A temporal retaining device 40, a charging device 3 as a charging unit, a developing device 5 as a developing unit are arranged in this order along the surface moving direction thereof around the photoconductor drum 1. A space is secured between the charging device 3 and the developing device 5 in such a manner that light emitted from an exposing device 4 as a latent electrostatic image forming unit can pass through to the photoconductor drum 1.

The charging device 3 negatively charges a surface of the photoconductor drum 1. The charging device 3 of the present embodiment is provided with a charging roller 3*a* as a charge member configured to conduct charging treatment by the so-called contact or close-charging method. In other words, the charging device 3 allows the charging roller 3*a* to be in contact with or adjacent to the surface of the photoconductor drum 1, thereby applying negative bias to the charging roller 3*a* to charge the surface of the photoconductor drum 1. Direct-current charge bias is applied to the charging roller 3*a* so that the surface potential of the photoconductor drum 1 is set to be −500V. Alternatively, alternating-current charge bias superposed on direct-current charge bias may be used as a charge bias. Further, the charging device 3 may be provided with a cleaning brush for cleaning the surface of the charging roller 3*a*. Alternatively, the cleaning brush may be configured to clean the surface of the charging roller 3*a* by a cleaning brush to prevent charging failure such as uneven charge caused by the charging roller 3*a*, even when a very small amount of toner adhesion occurs.

Additionally, a thin film may be wound around the surface of the charging roller 3*a* at both ends in the axial direction of the charging device 3 and placed so as to be in contact with the surface of the photoconductor drum 1. With this configuration, the surface of the charging roller 3*a* is in close proximity to the surface of the photoconductor drum 1, with only the thickness of the film being spaced away. Therefore, the charge bias applied to the charging roller 3*a* causes electric discharge between the surface of the charging roller 3*a* and the surface of the photoconductor drum 1, and the surface of the photoconductor drum 1 is charged by the discharge.

A latent electrostatic image corresponding to each color after exposing by the exposing device 4 shown as an exposing unit in FIG. 1 (not shown in FIG. 2) is formed on the surface of the thus charged photoconductor drum 1. The exposing device 4 writes the latent electrostatic image corresponding to each color with respect to the photoconductor drum 1 on the basis of image information corresponding to each color. In addition, the exposing device 4 of the present embodiment is based on a laser process but other processes made up of an LED array and an image forming unit can also be adopted.

The developing device 5 is provided with a developing roller 5*a* as a developer bearing member, which is partially exposed from an opening of the casing thereof. A two component developer consisting of toner and carrier is used herein. However, a carrier-free one component developer may be used. The developing device 5 accommodates therein toner corresponding to colors supplied from toner bottles 31Y, 31C, 31M and 31K, shown in FIG. 1. These toner bottles 31Y, 31C, 31M and 31K are attached to or detached from the main body of the image forming apparatus so that they can be exchanged respectively as a single unit. As a result, when toner is used up, only the toner bottles 31Y, 31C, 31M or 31K may be exchanged. Therefore, other members, which are still usable when the toner is used up, can be used as they are.

The toner loaded into the developing device 5 from the toner bottles 31Y, 31C, 31M and 31K, is conveyed by a supply roller 5*b* under stirred with carrier and the carrier borne on a developing roller 5*a*. The developing roller 5*a* consisting of a magnet roller as a magnetic field generating unit and a developing sleeve configured to coaxially rotate around the magnet roller. The carrier is conveyed to a developing unit facing the photoconductor drum 1, while the carrier in the developer stands on the developing roller 5*a* by magnetic force generated with the magnet roller. Here, the developing roller 5*a* is surface-moved to the same direction at a linear velocity faster than the surface of the photoconductor drum 1 at the developing unit facing the photoconductor drum 1.

Then, the surface of the photoconductor drum 1 is supplied with the toner adhered to the carrier surface, while the carrier standing on the developing roller 5*a* slidingly rubs the surface of the photoconductor drum 1. At this time, −300V developing bias is applied to the developing roller 5*a* from a power supply (not shown), by which a developing electrical field is formed at the developing unit. Then, an electrostatic force moving toward the latent electrostatic image is to act on the toner on the developing roller 5*a* between a latent electrostatic image on the photoconductor drum 1 and the developing roller 5*a*. Thereby, the toner on the developing roller 5*a* is adhered to the latent electrostatic image on the photoconductor drum 1. Upon adhesion, the latent electrostatic image on the photoconductor drum 1 is developed into a toner image corresponding to each color. Here, the developing roller 5*a* is connected to a driving device through a clutch, which allows to temporarily stopping the rotation of the developing roller 5*a*.

In FIG. 1, the intermediate transfer belt 10 of the transfer device 6 is stretched between three support rollers 11, 12, and 13 and configured to move endlessly toward a direction given in the arrow of the drawing. A toner image on each of the photoconductor drums 1Y, 1C, 1M and 1K is transferred on the intermediate transfer belt 10 by an electrostatic transfer process so as to be superimposed over each other. The electrostatic transfer process is also available as a configuration in which a transfer charger is used. In this instance, such a configuration is adopted that a primary transfer rollers 14Y, 14C, 14M and 14K producing a smaller quantity of transfer dust is used. Specifically, the primary transfer rollers 14Y, 14C, 14M and 14K are arranged as the respective transfer devices 6 at the back face of a part of the intermediate transfer belt 10 in contact with each of the photoconductor drums 1Y, 1C, 1M and 1K. In this instance, a primary transfer nip portion is formed by a part of the intermediate transfer belt 10 pressed by each of the primary transfer rollers 14Y, 14C, 14M and 14K, and each of the photoconductor drums 1Y, 1C, 1M and 1K. Then, in transferring a toner image on each of the photoconductor drums 1Y, 1C, 1M, 1K to the intermediate transfer belt 10, positive bias is applied to each of the primary transfer rollers 14Y, 14C, 14M and 14K. Thereby, a transfer electrical field is formed at each of the primary transfer nip portions, and the toner image on each of the photoconductors 1Y, 1C, 1M and 1K is electrostatically adhered on the intermediate transfer belt 10 so as to be transferred thereon.

A belt cleaning device 15 for removing toner remaining on the surface thereof is arranged around the intermediate transfer belt 10. The belt cleaning device 15 is configured to recover unnecessary toner adhered on the surface of the intermediate transfer belt 10 by using a fur brush and a cleaning blade. In addition, the thus recovered unnecessary toner is conveyed by a conveying unit (not shown) from the belt cleaning device 15 to a discharged toner tank (not shown).

A secondary transfer roller 16 is arranged in contact with a part of the intermediate transfer belt 10 stretched around the support roller 13. A secondary transfer nip portion is formed at a space between the intermediate transfer belt 10 and the secondary transfer roller 16, and a transfer sheet as a recording member is to be sent into the space at a predetermined timing. The transfer sheet is accommodated inside a feed cassette 20 below the exposing device 4 in FIG. 1 and conveyed up to the secondary transfer nip portion by a supply roller 21, a pair of resist rollers 22 and the like. Then, toner images superimposed on the intermediate transfer belt 10 are all together transferred on the transfer sheet at the secondary transfer nip portion. At the secondary transfer, positive bias is applied to the secondary transfer roller 16, by which a transfer electrical field is formed so as to transfer the toner images on the intermediate transfer belt 10 to the transfer sheet.

A heat fixing device 23 is arranged as a fixing unit at downstream of the secondary transfer nip portion in the conveying direction of transfer sheets. The heat fixing device 23 is provided with a heating roller 23*a* having a built-in heater and a pressing roller 23*b* for applying pressure. A transfer sheet, which has passed through the secondary transfer nip portion, is caught between these rollers and given heat and pressure. Thereby, toner on the transfer sheet is melted and a toner image is fixed on the transfer sheet. The transfer sheet after being fixed is discharged by a discharging roller 24 on a discharge tray on the upper face of an apparatus.

Figure 3:
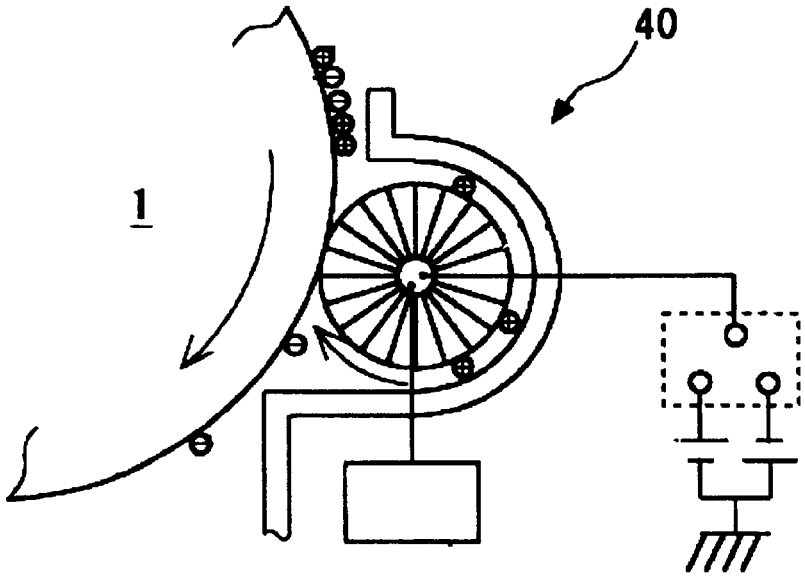
FIG. 3 is a schematic view exemplifying a configuration of a temporal retaining device.

As shown in FIG. 2, an image forming apparatus has the temporal retaining device 40 and a developing device 5, wherein the temporal retaining device 40 is configured to recover and retain residual toner remaining on the photoconductor drum 1 as a latent electrostatic image bearing member after transferring by means of the transferring unit from the photoconductor drum 1, and then return the retained residual toner to the photoconductor drum 1 (as shown in an enlarged view in FIG. 3), and the developing device 5 as a recovering unit is configured to recover the residual toner from the photoconductor drum 1.

Figure 6:
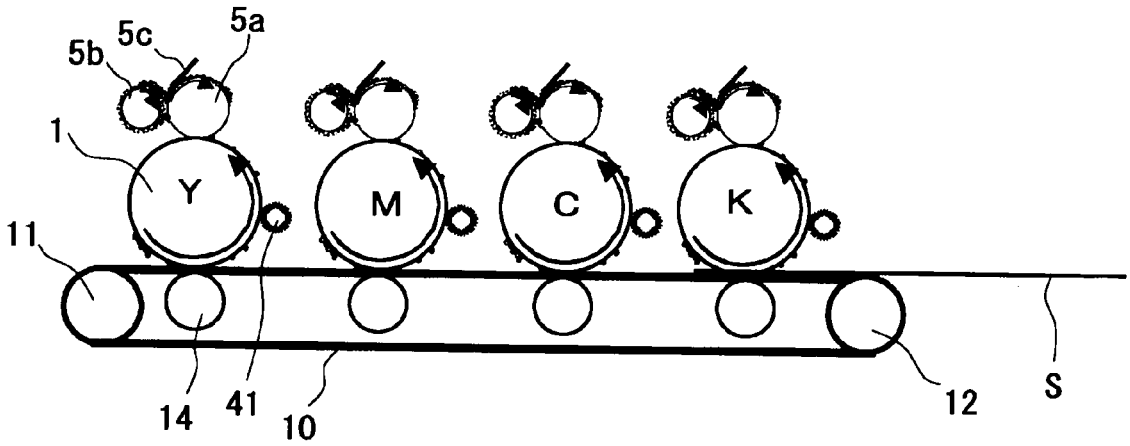
FIG. 6 is a schematic view exemplifying an arrangement of developing devices for respective colors in a tandem image forming process.

The toner in the toner supplying unit inside the container of the developing device 5 is conveyed to the nip portion of the developing roller 5*a*, while being stirred by the supply roller 5*b*. Further, the amount of toner on the developing roller 5*a* is regulated by a regulating blade 5*c*, thereby forming a thin toner layer on the developing roller 5*a* as shown in FIG. 6. The toner is also slidingly rubbed at the nip portion between the supply roller 5*b* and the developing roller 5*a* and at the contact portion between the regulating blade 5*c* and the developing roller 5*a* so as to be controlled to an appropriate charge amount. In a cleaner-less process, particularly, in order to recover the residual toner, the charge amount of the toner is significantly deviated from an appropriate value. Therefore, the toner recovered by the developing roller 5*a* must be sufficiently scraped away and removed by the supply roller 5*b*.

The developing roller 5*a* and the supply roller 5*b* are rotated in opposite directions (counter rotations) at the nip portion. At this time, the difference in circumferential speed $\theta$ is preferably in a range of $0.6 \leqq \theta \leqq 2$. When $\theta$ is less than 0.6, the developing roller 5*a* cannot be sufficiently supplied with the toner. Additionally, the slidingly rubbing force between a case covering the developing roller 5*a* or the supply roller 5*b* and the toner is small, it may be difficult to increase the charge amount up to a desired level. On the other hand, when $\theta$ is more than 2, the torque for driving and rotating the developing roller 5*a* or the supply roller 5*b* is increased to generate heat. Such new problem occurs.

Further, since toner recovered at the developing unit is reused in a cleaner-less system, it is necessary to re-adjust the charge amount of the recovered toner. In this respect, it is preferable to increase the rotational speed of the supply roller 5*b*.

In view of improvement in charge amount of toner, it is preferable that bias be applied to the developing roller 5*a* and the supply roller 5*b*. The bias electric voltage may be any of direct-current electric voltage, alternating-current electric voltage, and alternating-current electric voltage superposed on direct-current electric voltage. A regulating blade 5*c*, which is a regulating member for regulating the amount of toner on the developing roller 5*a*, may include a metal blade, a resin blade, a metal roller and a resin roller. A blade is preferably used in miniaturizing an apparatus. The pressing force of the regulating blade 5*c* against the developing roller 5*a* is preferably in a range of 20 N/m to 100 N/m. When the pressing force is low, the toner amount is insufficiently regulated or the toner is insufficiently charged. On the other hand, when the pressing force is high, stress is unduly given to toner or the developing roller 5*a*, causing poor image on endurance. Moreover, direct-current electric voltage, alternating-current electric voltage, or alternating-current electric voltage superposed on direct-current electric voltage may be applied to the regulating blade 5*c* and developing roller 5*a*, if necessary.

(Transferring Step)

As shown In FIG. 1, a transferring unit is disposed below each of the process units. In the transferring unit an endless intermediate transfer belt 10 endlessly rotates in a counterclockwise direction in the figure while stretching it around a plurality of stretching rollers 11, 12, 13. The stretching rollers 11, 12, 13 are specifically a driving roller, a driven roller and tension roller. Each of primary transfer rollers 14Y, 14M, 14C, 14K is a roller consisting of a core made of a metal and elastic body such as a sponge coated therewith, which is pressed toward each of the photoconductor drums 1Y, 1M, 1C, 1K so that the intermediate transfer belt 10 is caught between the primary transfer rollers and the photoconductor drums. Thus, primary transfer nips for Y, M, C, K are formed along the belt moving direction between the photoconductor drums 1Y, 1M, 1C, 1K and the intermediate transfer belt 10.

A primary transfer bias electric voltage, which is constant current controlled by a transfer bias power supply (not shown) is applied to the core metals of the primary transfer rollers 14Y, 14M, 14C, 14K. This allows applying a transfer charge to the back surface of the intermediate transfer belt 10 through each of the primary transfer rollers 14Y, 14M, 14C, 14K so as to generate transfer electric field at each primary transfer nip between the intermediate transfer belt 10 and each of the photoconductor drums 1Y, 1M, 1C, 1K. In this printer, each of the primary transfer rollers 14Y, 14M, 14C, 14K is arranged as a primary transferring unit, a brush, blade and the like may be used instead of the roller. Moreover, a transfer charger may be also used.

Y, M, C, K toner images respectively formed on the photoconductor drums 1Y, 1M, 1C, 1K for each color are transferred superimposingly at the primary transfer nips for each color on the intermediate transfer belt 10. Thereby, a four-colored toner image is formed on the intermediate transfer belt 10.

The secondary transfer roller 16 is in contact with the surface of the intermediate transfer belt 10 at which the belt is stretched around a roller located on the back surface thereof, thereby forming a secondary transfer nip portion. The secondary transfer bias is applied to the secondary transfer roller 16 by means of an electric voltage application unit consisting of a power supply, wiring and the like (not shown). The secondary transfer electric field is formed between the secondary transfer roller 16 and the grounded roller located on the back surface of the belt at the secondary transfer nip portion. The four-colored toner image formed on the intermediate transfer belt 10 goes into the secondary transfer nip portion along with the endless movement of the belt.

When the toner images formed on the photoconductor drums 1Y, 1M, 1C, 1K are transferred on the intermediate transfer belt 10, the intermediate transfer belt 10 is preferably pressed and contacted with the photoconductor drums 1Y, 1M, 1C, 1K. The press-contact force is preferably 10 N/m to 60 N/m.

It is considered that the toner having charge "q" is moved by force "F" (F=qE) which is applied by an electric field "E" generated between the photoconductor drum 1 and a transfer medium such as the intermediate transfer belt 10. The reverse transfer toner may occur because the toner charged to have the opposite polarity to the normal toner polarity is present in the toner transferred on the transfer medium. Thus, a reverse polarity toner is necessarily reduced to prevent the reverse transfer toner. However, it is difficult to completely avoid the occurrence of the reverse polarity toner.

Alternatively, the toner may be designed to improve interparticle non-electrostatic adhesion force so as to prevent the reverse transfer toner. However, the interparticle adhesion force is increased by the toner design, the flowability of the toner is outstandingly decreased, and there occur problems such as poor conveyance, increase of running torque of the developing roller 5*a* and supply roller 5*b*, and the like. Moreover, developing ability becomes poor. Thus, it is not a suitable method.

To overcome such a problem, it is considered to use a method of decreasing the interparticle adhesion force to be forced to be firmly incontacted each other by increasing transfer pressure while properties such as flowability and developing property of the toner is maintained. However, only increasing the transfer pressure is not sufficient in preventing the reverse transfer toner.

Figure 4:
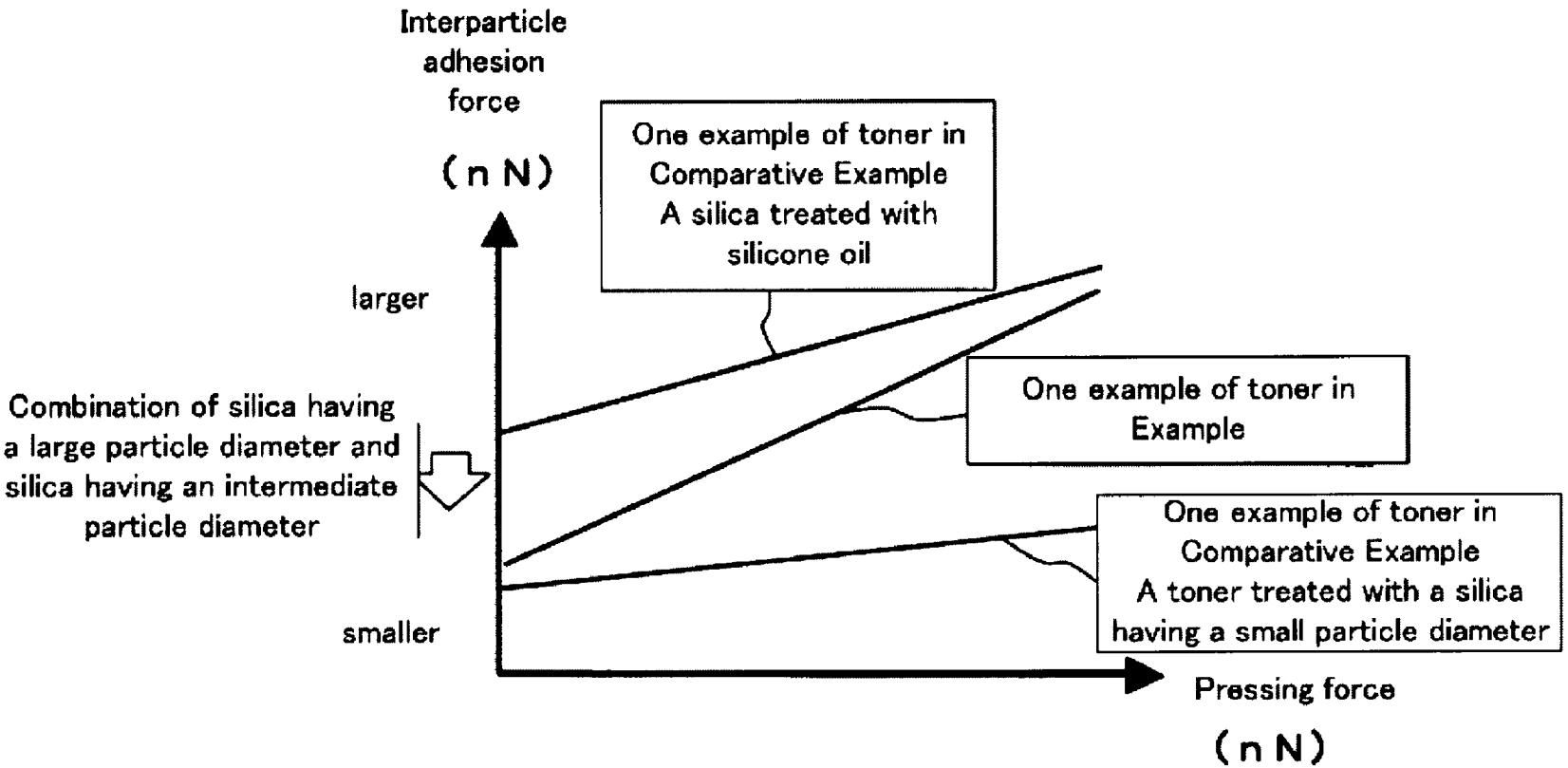
FIG. 4 is a graph illustrating a relation between pressing force and interparticle adhesion force of toners.
Figure 5:
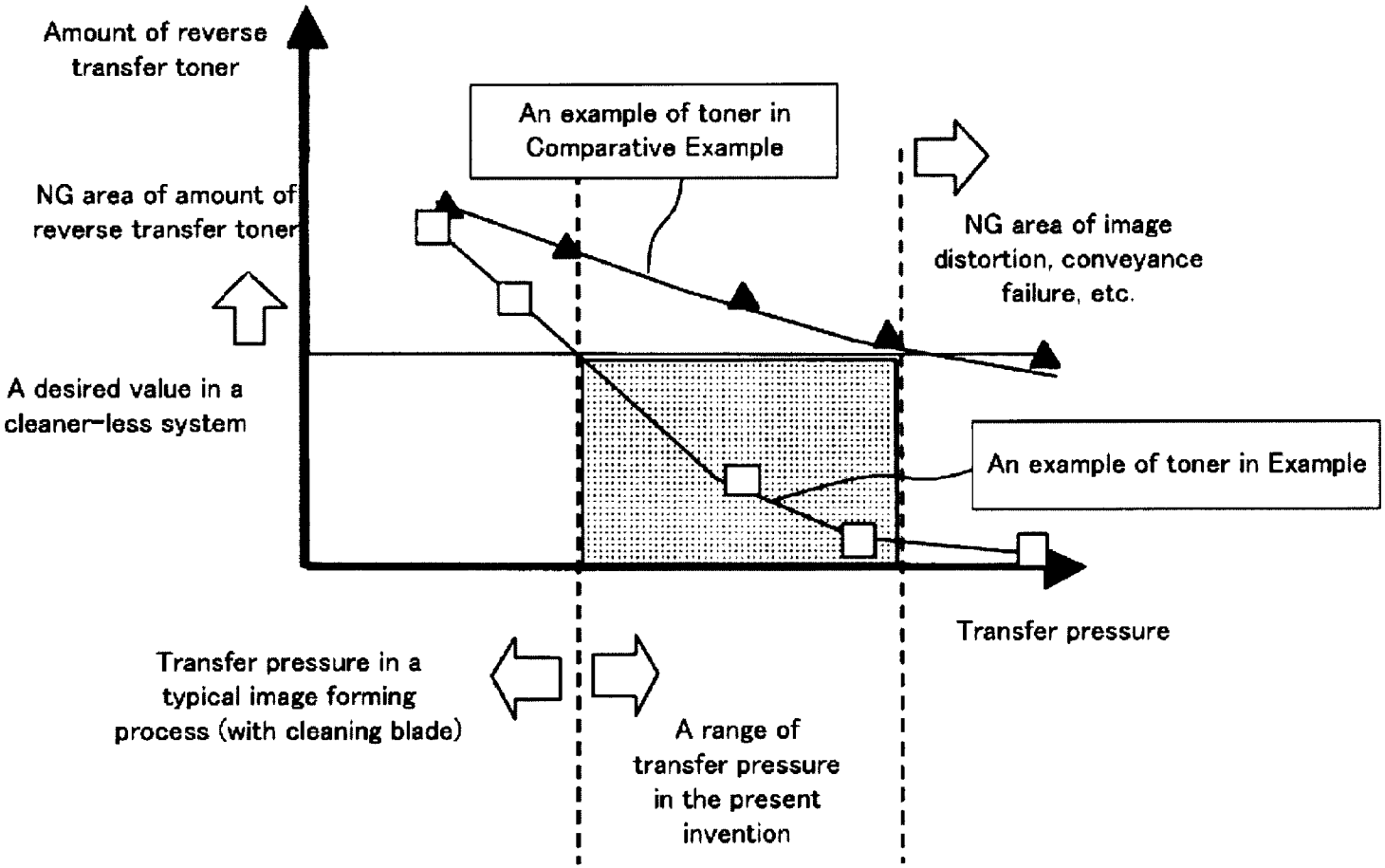
FIG. 5 is a graph illustrating a relation between transfer pressure and the amount of the reverse transfer toner.

As a result of study in view of the current situation described above, it is found that the reverse transfer toner hardly occurs by applying a small pressure to the toner when transferring, in the case of the toner which is the toner adhesion is low in a static state, and the interparticle non-electrostatic adhesion force of toners is increased by applying pressure to the toner (see FIG. 4). In order to control the interparticle adhesion force, the toner is preferably subjected to external additive treatment using inorganic fine particles treated with silicone oil, and inorganic fine particles not treated with silicone oil having a primary particle diameter of 50 nm to 150 nm. When the toner is treated only with inorganic fine particles, the adhesion force does not greatly change by applying pressure. In addition, when the toner is treated only with inorganic fine particles treated with silicone oil, the adhesion force greatly changes with pressure increase. The average primary particle diameter of the inorganic fine particles not treated with silicone oil is set to 50 nm or more, because those of less than 50 nm are easily embedded in a toner surface, and easily cause poor toner properties during endurance. The average primary particle diameter of the inorganic fine particles not treated with silicone oil is set to 150 nm or less, because those of more than 150 nm can be prevented from embedding to the toner surface, but are easily separated from the toner because of small adhesion. These also easily cause not only poor toner properties during endurance, but also poor image quality.

When the inorganic fine particles treated with silicone oil, and the inorganic fine particles not treated with silicone oil having large and intermediate particle diameters are used in combination, the adhesion force greatly increases with increasing pressing force as shown in a graph in FIG. 4. Specifically, the reverse transfer toner is effectively prevented by using the toner in which the interparticle adhesion force changes with increasing pressure application as shown in FIG. 4 and by applying a transfer pressure of 10 N/m to 60 N/m. When the press-contact force is less than 10 N/m, the toner unevenly contacts on the transfer medium, and thus, uneven transfer occurs. The press-contact force of more than 60 N/m causes dropout, which is a phenomenon that the center of the image on a photoconductor drum is not sufficiently transferred to a medium. In the present invention, the press-contact force is preferably 20 N/m to 60N/m. When the press-contact force is less than 20 N/m, the toner is not firmly incontacted on the transfer medium and reversely transferred in the photoconductor drum of the developing device located in the downstream of the medium conveyance direction.

FIG. 6 is a schematic view exemplifying an arrangement of developing devices for each color in a tandem image forming process. It is preferred that the upstream transfer pressure be higher and the downstream transfer pressure be lower for the purpose of increasing the interparticle adhesion force as much as possible to prevent the transferred toner from reversely transferring to the latent electrostatic image bearing member, when the toner transferred in the upstream is slidingly rubbed at the transfer nip portion in the downstream of a medium conveyance direction. That is, when the transfer pressure of "n" th color toner is defined as "P(n)" and the transfer pressure of "(n+1)" th color is defined as "P(n+1)", P(n) and P(n+1) preferably satisfy the relation of P(n)>P(n+1) upon transferring the toner image formed on the latent electrostatic image bearing member on the transfer medium.

Moreover, when the interparticle adhesion force of the toner transferred on the transfer medium as (n) th color is defined as "Ft(n)" and the interparticle adhesion force of the toner transferred on the transfer medium as (n+1)th color is defined as "Ft(n+1)", Ft(n) and Ft(n+1) preferably satisfy the relation of Ft(n)>Ft(n+1). This is because when the toner transferred in the upstream passes through the transfer nip portion in the downstream, the toner layer is slidingly rubbed, and by the slidingly rubbing force, the press-packed condition of the transferred toner is changed. Specifically, the toner having strong interparticle adhesion force is preferably used, because the press-packed condition of the transferred toner in the upstream is hardly changed by slidingly rubbing at the transfer nip portion.

In addition to the above conditions, to transfer the toner image on the photoconductor drums 1Y, 1C, 1M and 1K to the transfer medium S, electric field is generated by applying bias voltage to each of the photoconductor drums 1Y, 1C, 1M and 1K, the intermediate transfer belt 10, and each of the primary transfer rollers 14Y, 14C, 14M and 14K facing thereto. The electric voltage to be applied has the opposite polarity to the normal toner charge, and the electric voltage of 500V to 1,500V is preferably applied. Moreover, an appropriate difference in circumferential speed is preferably provided between each of the photoconductor drums 1Y, 1C, 1M, 1K and the intermediate transfer belt 10 or transfer medium S to improve toner transfer ability. Specifically, the difference in circumferential speed is preferably 1% to 10%. The difference in circumferential speed of less than 1% is less effective to improve transfer ability. The difference in circumferential speed of more than 10% adversely affects image quality, such as image distortion.

(Prevention of Reverse Transfer Toner)

Figure 7A:
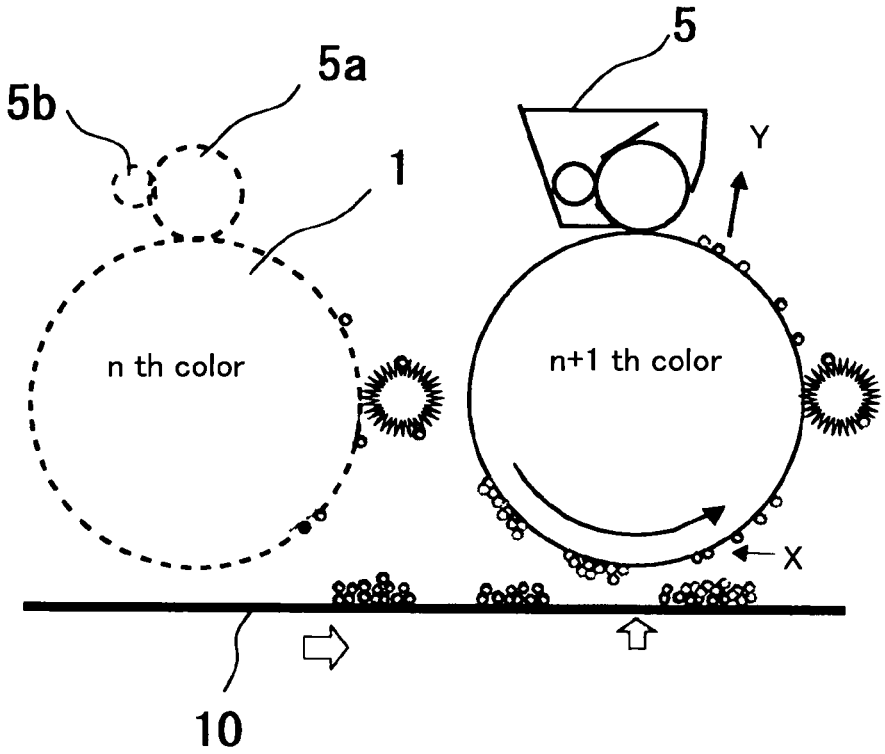
FIG. 7A is a schematic view illustrating the condition in which reverse transfer toner occurs and colors are mixed under low transfer pressure.

FIG. 7A is a schematic view illustrating a condition in which reverse transfer toner occurs and colors are mixed under low transfer pressure. As shown in FIG. 7A, in a tandem full color image forming process, a toner image which is once transferred on the intermediate transfer belt 10 is subjected to a transferring step again when the next color is transferred, at that time, the toner previously transferred to the intermediate transfer belt 10 is reversely transferred on the photoconductor drum 1. In FIG. 7A, the reverse transfer toner occurs in the position X, and colors are mixed in the position Y. Particularly, in an image forming process in which a member configured to remove and dispose of the toner on the photoconductor drum 1 is not provided and the toner is reused, the color mixture of the toner goes on while printing is repeated. Thereby, there occur problems, such as a desired color reproducibility cannot be obtained.

Figure 7B:
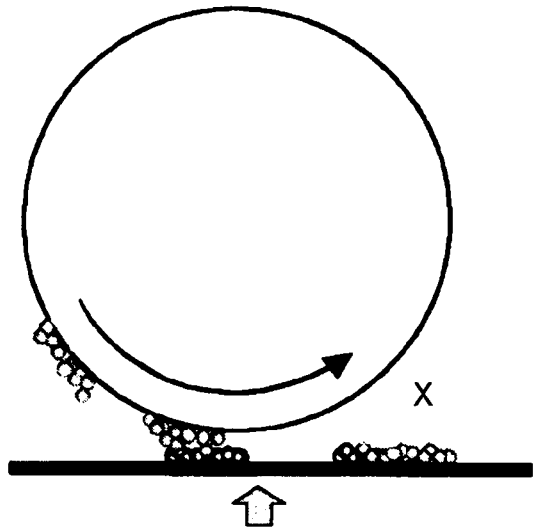
FIG. 7B is a schematic view illustrating the condition in which no reverse transfer toner occurs under high transfer pressure.

FIG. 7B is a schematic view illustrating the condition in which no reverse transfer toner occurs under high transfer pressure. No reverse transfer toner occurs in the position X.

A transfer member is in contact with the photoconductor drum 1, and the transfer pressure in the transfer position is generally 10 N/m to 60 N/m. However, in the present invention, the transfer pressure in the nip portion is preferably set to 30 N/m to 60 N/m. When off-set fixed by a transfer belt method, the pressure at the end edge of the nip may be larger than that at the front edge of the nip. Examples of the intermediate transfer belt 10 include a roller and belt. In a direct transfer method, the toner is directly transferred to the transfer medium. For the belt transfer member, resins such as polyamide, polyimide, polycarbonate, polyethylene terephthalate, PTFE, polyethylene, polypropylene, polyurethane and the like can be used.

The transfer belt member preferably has a thickness of 0.05 mm to 5 mm. The thickness of less than 0.05 mm may pose a problem in durability. The thickness of more than 5 mm may cause high cost and decrease the manufacturing property of belt. Examples of the roller members include common rubber rollers made of natural rubber, semisynthetic rubber and synthetic rubber. Additionally, an elastic roller in which a skin layer disposed on a polyurethane roller or foam may be used.

The transfer bias is applied to the belt by applying the opposite bias to the normal toner charge. For example, in an image forming method using negatively charged toner, the transfer bias is preferably direct-current bias of +400V to +1,200V. Alternatively, alternating-current bias may be used in order to improve transfer ability.

Moreover, to improve transfer ability, the difference in circumferential speed is provided between the photoconductor drum 1 and the intermediate transfer belt 10.

(Toner)

As the toner used in the present invention, a toner containing at least a resin, colorant and additive can be used. Examples of the method for producing a toner include a pulverization method and polymerization method. Other known materials can be used for the toner used in the present invention.

The toner preferably has a volume average particle diameter of 4 μm or more to less than 8 μm.

Examples of the binder resins include styrenes and polymers of the substitution product thereof such as polystyrene, poly(p-chlorostyrene) and polyvinyltoluene; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinyl methyl ketone copolymer, styrene-butadiene copolymer, styrene-isoprene copolymer, and styrene-acrylonitrile-indene copolymer, styrene-maleic acid copolymer, styrene-maleate copolymer; polymethylmethacrylate, polybutylmethacrylate, polyvinyl chloride, polyvinyl acetate, polyethylene, polypropylene, polyesters, epoxy resins, epoxy polyol resins, polyurethane, polyamide, polyvinyl butyral, polyacrylic acid resins, rosin, modified rosin, terpene resins, aliphatic or alicyclic hydrocarbon resins, aromatic petroleum resins, chlorinated paraffin and paraffin wax. Examples of incompatible combinations thereof include combinations of resins with significantly different characteristics such as combinations of styrene butyl acrylate copolymer and polyesters; combinations of styrene butyl acrylate copolymer and epoxy resins; combinations of styrene butyl acrylate copolymer and epoxy-polyol resins, combinations of same kinds of resins but having significantly different molecular-weight distributions, and combinations of same kinds of resins but having significantly different substituents.

Examples of epoxy-polyol resins include, as disclosed in Japanese Patent Application No. 5-119826, a polyol (A) obtained form a reaction of a compound having (i) an epoxy resin such as a bisphenol A epoxy resin, (ii) an alkylene oxide adduct of divalent phenol or glycidyl ether thereof and (iii) an active hydrogen reacting with an epoxy group, in a molecule; and a polyol (B) obtained form a reaction of a compound having (i) an epoxy resin such as a bisphenol A epoxy resin, (ii) a divalent phenol and (iii) an active hydrogen reacting with an epoxy group, in a molecule.

The colorant is not particularly limited and may be appropriately selected from the known dyes and pigments. Examples thereof include carbon black, nigrosine dyes, iron black, Naphthol Yellow S, Hansa Yellow (10G, 5G, G), Cadmium Yellow, Yellow Iron Oxide, Yellow Ocher, Chrome Yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, Anthracene Yellow BGL, Isoindolinone Yellow, Colcothar, Red Lead Oxide, Lead Red, Cadmium Red, Cadmium Mercury Red, Antimony Red, Permanent Red 4, Para Red, Fire Red, Parachlororthonitroaniline Red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y. Alizarine Lake, Thioindigo Red B, Thioindigo Maroon, Oil Red, Quinacridone Red, Pyrazolone Red, Polyazo Red, Chrome Vermilion, Benzidine Orange, Perynone Orange, Oil Orange, Cobalt Blue, Cerulean Blue, Alkali Blue Lake, Peacock Blue Lake, Victoria Blue Lake, metal-free Phthalocyanine Blue, Phthalocyanine Blue, Fast Sky Blue, Indanthrene Blue (RS, BC), Indigo, Ultramarine, Prussian Blue, Anthraquinone Blue, Fast Violet B, Methyl Violet Lake, Cobalt Violet, Manganese Violet, Dioxazine Violet, Anthraquinone Violet, Chrome Green, Zinc Green, Chromium Oxide, Viridian, Emerald Green, Pigment Green B, Naphthol Green B, Green Gold, Acid Green Lake, Malachite Green Lake, Phthalocyanine Green, Anthraquinone Green, Titanium Oxide, Zinc White, Lithopone and a combination thereof. The amount of the colorant in the toner is usually 0.1 parts by mass to 50 parts by mass relative to 100 parts by mass of the binder resin.

The toner of the invention may include a charge control agent if necessary. As the charge control agent, any known charge control agents may be used, and examples thereof include nigrosine dyes, triphenylmethane dyes, chromium-containing metal complex dyes, molybdic acid chelate pigments, Rhodamine dyes, alkoxy amine, quaternary ammonium salts (including fluorine-modified quaternary ammonium salt), alkylamide, phosphorus as an element or a compound, tungsten as an element or a compound, fluorine activator, metal salt of a salicylic acid and metal salt of salicylic acid derivative.

In the present invention, the amount of the charge control agent varies depending on the method for producing the toner including the type of the binder resin, the presence or absence of the optionally used additives and the dispersion method, and it may not be uniquely determined. It is, however, based on 100 parts by mass of the binder resin, preferably 0.1 parts by mass to 10 parts by mass, more preferably 2 parts by mass to 5 parts by mass is used. Less than 0.1 parts by mass causes insufficient negative charge amount of toner, and is impractical. More than 10 parts by mass excessively increases the charge amount of the toner. The increase of the electrostatic attraction with carrier or a charging member causes poor flowability of the developer and poor image quality.

Examples of other additives include metal salts of fatty acid such as zinc stearate, aluminum stearate, and other metal salts such as aluminum oxide, tin oxide and antimony oxide, and fluoropolymer.

(External Additive)

In the present invention, it is preferred that appropriate flowability and electrostatic property be given to the toner particles by coating the surface of the toner particles with an external additive, that cleanability be improved, and that stress caused from a contact member such as a charging member for photoconductor is reduced. The coverage of the external additive on the toner surface is preferably 5% to 99%, and more preferably 10% to 99%.

Examples of the external additives include metal oxides such as aluminum oxide, titanium oxide, strontium titanate, cerium oxide, magnesium oxide, chromium oxide, tin oxide, zinc oxide, nitride (silicon nitride), carbide (silicon carbide), metal salt (calcium sulfate, barium sulfate, calcium carbonate), metal salts of fatty acid (zinc stearate and calcium stearate), carbon black and silica. The amount of external additive is preferably 0.01 parts by mass to 10 parts by mass, more preferably 0.05 parts by mass to 5 parts by mass, in 100 parts by mass of tone particles. These external additives may be used alone or in combination. The external additives subjected to hydrophobization treatment is more preferably used.

The inorganic fine particles used in the present invention are at least one selected from silica, alumina, titania and a composite oxide thereof in order to improve charge stability, developing property, flowability and storage property. Of these, silica is more preferable. As the silica, both so-called dry silica or fumed silica produced by a vapor phase oxidation of a silicon halide or alkoxide, and so-called wet silica produced from water glass or the like can be used. Of these, dry silica having a small number of silanol groups on the surface and inside silica fine particles generating a small amount of production residue such as $Na_2O$ or $SO_3$ is more preferable. In the production step of dry silica, for example, a metal halide such as aluminum chloride or titanium chloride, and a silicon halide can be used in combination to produce a composite fine powder of silica and other metal oxide, and the composite fine powder is also included in the scope of dry silica.

In the present invention, the inorganic fine particles having a particle diameter of approximately 5 nm to 200 nm can be appropriately used.

In order to hydrophobize and control electrostatic property, the external additives (inorganic fine particles) may be treated with a treating agent, such as silicone varnishes, various modified silicone varnishes, silicone oils, various modified silicone oils, silane coupling agents, silane coupling agents having a functional group, other organic silicon compounds or organotitanium compounds. These may be used alone or in combination. To maintain high charge amount and achieve low consumption amount and high transfer rate, the inorganic fine particles are more preferably treated with at least silicone oil.

These external additives are stirred and mixed with a toner base by a mixing machine so as to mechanically adhere to the toner base surface. Examples of the mixing machines include a Henschel mixer (by MITSUI MINING. CO., LTD.), Super mixer (by KAWATA MFG. Co., Ltd.), Ribocone (by OKAWARA CORPORATION), Nauta mixer, Turbulizer and Cyclomix (all by Hosokawa Micron Corporation), Spiral pin mixer (by Pacific Machinery & Engineering Co., Ltd.) and Lodige mixer (by MATSUBO Corporation).

(Control of Particle Adhesion Force)

Examples of methods of controlling the interparticle adhesion force include a method of controlling adhesion of base resin itself by means of resin design and a method of changing kinds and amounts of an external additive, and an external additive treatment method.

(Measurement Method of Interparticle Adhesion Force)

Examples of the methods of measuring the adhesion force of a particle of toner include a centrifuge separation method, a method in which a toner particle adhered to the tip of the probe in SPM (scanning probe microscope) is contacted with a toner layer on a substrate to measure its adhesion force, and a method using commercially available device for measuring interparticle adhesion force (PAF-300N by Nano Seeds Corporation).

EXAMPLES

The present invention will be described in more detail referring to Examples and Comparative Examples hereinafter. It should be understood that the examples do not limit the present invention. In the following description, every "part(s)" means part(s) by mass.

Example 1

1. Preparation of Measurement Sample

A toner and a carrier were mixed to a toner concentration of 5% by mass, and then stirred for 5 minutes to produce a developer. The developer was coated on an ITO glass substrate (20-mm-square) having an adhesion amount of 10 $g/m^2$ by a cascade method in the condition of the developing gap of 1 mm and developing bias of +500V so as to form a uniform thin toner layer. The thin toner layer was pressurized by pressures at various levels of 5 kPa, 15 kPa, 25 kPa, and 50 kPa.

2. Measurement

The glass substrate on which the pressed thin toner layer was formed was placed in a scanning probe microscope (by Seiko Instruments Inc.). An epoxy resin adhesive was attached on the tip of the probe, the tip of the probe was contacted with the thin toner layer, and then left to stand for approximately 30 minutes until the adhesive set. Subsequently, the probe was gradually pulled away from the thin toner layer. The deflection amount of the probe at the moment when the probe was pulled away from the toner was measured, and then interparticle adhesion force was found from a spring constant and the deflection amount. This process was performed on respective pressure conditions, and the interparticle adhesion force was plotted against a pressure per particle which is calculated from a toner particle diameter. From the plotted graph, adhesion force when the pressure of 500 nN was applied on a toner particle was obtained.

3. Production of toner base

To obtain the toner to be used in Examples and Comparative Examples of the present invention, base toner particles having a volume average particle diameter of 4 μm to 8 μm were prepared by a polymerization method. When the volume average particle diameter was less than 4 μm, there was fear that adverse affect health, for example, lung in case of suction. On the other hand, the volume average particle diameter was more than 8 μm caused poor image quality.

By using a HENSCHEL MIXER, 40 parts of copper phthalocyanine blue (by TOYO INK MFG. CO., LTD.), 60 parts of a polyester resin selected from the above-described binder resin (RS-801, acid value: 10, molecular mass: 20,000, glass transition temperature Tg: 64° C., manufactured by Sanyo Chemical Industries, Ltd.), and 30 parts of water were mixed by a Henschel mixer to obtain a mixture where pigment aggregates were impregnated with water. The mixture was kneaded by using two rollers the surfaces of which were set at 130° C. for 45 minutes, and pulverized with a pulverizer into the size of 1 mm to obtain [masterbatch 1].

4. Preparation of Pigment-Wax Dispersion (Oil Phase)

To a vessel equipped with a stirrer bar and a thermometer, 545 parts of a polyester resin, 181 parts of wax (paraffin wax HLP11 manufactured by NIPPON SEIRO CO., LTD.), 1,450 parts of a mixed solution of ethyl acetate and methyl ethyl ketone (ethyl acetate: methyl ethyl ketone=60 volume %:40 volume %, herein after referred to as 60/40 volume %) were loaded and the temperature was raised to 80° C. under stirring, maintained at 80° C. for 5 hours, and cooled to 30° C. in 1 hour. Next, 500 parts of [masterbatch 1], and 100 parts of a mixed solution of ethyl acetate and methyl ethyl ketone (60/40 volume %) were loaded into the vessel, and mixed for 1 hour to obtain [initial material solution 1].

To a vessel, 1,500 parts of the [initial material solution 1] was transferred, and a copper phthalocyanine blue pigment and wax were dispersed using a bead mill (Ultra Visco Mill, manufactured by AIMEX CO., LTD.) under the conditions of liquid feed rate 1 kg/hr, disk circumferential speed of 6 m/sec, 0.5 mm zirconia beads filled to 80% by volume and three passes (three times). Next, 425 parts of [polyester 1] and 230 parts of a mixed solution of ethyl acetate and methyl ethyl ketone (60/40 volume %) was added to the dispersed solution and then dispersed once (1 pass) by using the bead mill under the same conditions as described above to obtain [pigment-wax dispersion 1]. The [pigment-wax dispersion 1] was adjusted by using a mixed solution of ethyl acetate and methyl ethyl ketone (60/40 volume %) so that the solution had 50% concentration of solid content (130° C., 30 minutes).

5. Preparation of aqueous phase

By mixing and stirring 970 parts of ion exchanged water, 40 parts of 25 mass % aqueous dispersion of organic resin fine particles for stable dispersion (copolymer of styrene-methacrylic acid-butyl acrylate-sodium salt of methacrylic acid ethylene oxide adduct sulfate), 140 parts of a 48.5% aqueous solution of sodium dodecyl diphenylether disulfonic acid (ELEMINOL MON-7 manufactured by Sanyo Chemical Industries, Ltd.) and 90 parts of a mixed solution of ethyl acetate and methyl ethyl ketone (60/40 volume %), a translucent white liquid was obtained. The liquid is defined as [aqueous phase 1].

6. Emulsification Step

By using a TK homomixer (manufactured by Tokushu Kika Kogyo Co., Ltd.), 1,275 parts of [pigment-wax dispersion 1], and 2.6 parts of isophoronediamine as amines were mixed at 5,000 rpm for 1 minute. Then 88 parts of [prepolymer 1] was added thereto and mixed at 5,000 rpm for 1 minute by using the TK homomixer (manufactured by Tokushu Kika Kogyo Co., Ltd.). After that, 1,200 parts of [aqueous phase 1] was added thereto and mixed by using the TK homomixer with adjusting its rotational frequency 8,000 rpm to 13,000 rpm for 20 minutes to obtain [emulsion slurry 1].

7. Desolvation

[Emulsion slurry 1] was loaded in a vessel equipped with a stirrer and a thermometer, and then the solvent was removed at 30° C. for 8 hours to obtain [dispersion slurry 1].

8. Washing and Drying

After filtering 100 parts of [dispersion slurry 1] under reduced pressure, (1): 100 parts of ion exchanged water was added to the filter cake, mixed by using the TK homomixer at a rotational frequency of 12,000 rpm for 10 minutes and subsequently filtered.

(2): 900 parts of ion exchanged water were added to the filter cake of (1), mixed by using the TK homomixer at a rotational frequency of 12,000 rpm for 30 minutes with adding supersonic vibration and subsequently filtered under reduced pressure. These procedures were repeated until the reslurry solution had a conductivity of 10 μC/cm or less.

(3): 10% hydrochloric acid was added to the reslurry solution so that the solution had a pH of 4, and the solution was stirred by using a three-one motor for 30 minutes and subsequently filtered.

(4): 100 parts of ion exchange water were added to the filter cake of (3), mixed by using the TK homomixer at a rotational frequency of 12,000 rpm for 10 minutes, and subsequently filtered. These procedures were repeated until the reslurry solution had a conductivity of 10 μC/cm or less to obtain [filter cake 1].

[Filter cake 1] was dried by using an air-circulation dryer at 42° C. for 48 hours, and sieved through a sieve of 75 μm mesh to obtain [toner base 1]. The [toner base 1] had a volume average particle size (Dv) of 5.9 μm, a number average particle size (Dp) of 5.6 μm, a Dv/Dp of 1.11, an average circularity of 0.976, measured by Multi Sizer 3 (by Beckman Coulter, Inc.)

To 100 parts of the base toner prepared above, as external additives 1.0 part of silica particles treated with a silicone oil (RY200 by Nippon Aerosil Co., Ltd.) and 0.5 parts of silica particles having a large diameter (UFP-30 by DENKI KAGAKU KOGYO KABUSHIKI KAISHA) were added, and then mixed and stirred together for 5 minutes by a Henschel mixer (FM20 by MITSUI MINING CO., LTD.) to be subjected to external additive treatment. The obtained toner had an interparticle adhesion force of 600 nN when pressed at 500 nN per particle.

The obtained toner was loaded in a commercially available color printer (C5800n manufacture by Oki Data Corporation) which was modified and adjusted so that the transfer pressure was a linear pressure of 30N/m, and then an image was output to be evaluated.

The image was evaluated in such a manner that a color chart in which a printed image area for each color was 5% was prepared and printed on 5,000 of A4 plain sheets in succession.

The change of hue was evaluated in such manner that ΔE of each of yellow, magenta and cyan was measured on a spectrocolorimeter (CM-2600 by KONICA MINOLTA HOLDINGS, INC.) and evaluated on the following criteria.

A: ΔE was less than 5.

B: ΔE was 5 to less than 10.

C: ΔE was more than 10.

The dropout was evaluated in such manner that an image of 2 mm line width was output and visually observed under an optical microscope to check occurrence of dropout on the following evaluation criteria.

A: No outstanding dropout occurred until 5,000 sheets were printed.

B: A minor dropout occurred before 2,000 sheets were printed.

C: An outstanding dropout occurred before 1,000 sheets were printed.

Evaluation results are shown in Table 1.

Example 2

The externally additive-treated toner produced in Example 1 was used.

The toner was loaded in a commercially available color printer (C5800n manufacture by Oki Data Corporation) which was modified by adjusting a spring pressure so that the transfer pressure was a linear pressure of 45N/m, and then an image was output to be evaluated according to the above-described image evaluation.

Evaluation results are shown in Table 1.

Example 3

The externally additive-treated toner produced in Example 1 was used.

The toner was loaded in a commercially available color printer (C5800n manufacture by Oki Data Corporation), which was modified by adjusting a spring pressure so that the transfer pressure was a linear pressure of 60N/m, and then an image was output to be evaluated according to the above-described image evaluation.

Evaluation results are shown in Table 1.

Example 4

To 100 parts of the base toner prepared as in Example 1, as external additives 2.0 parts of silica particles treated with a silicone oil (RY200 by Nippon Aerosil Co., Ltd.) and 1.0 part of silica particles having a large diameter (UFP-30 by DENKI KAGAKU KOGYO KABUSHIKI KAISHA) were added, and then mixed and stirred together for 5 minutes by a Henschel mixer (FM20 by MITSUI MINING. CO., LTD.) to be subjected to external additive treatment. The obtained toner had an interparticle adhesion force of 980 nN when pressed at 500 nN per particle. The toner was loaded in a commercially available color printer (C5800n manufacture by Oki Data Corporation), which was modified and adjusted so that the transfer pressure was a linear pressure of 30N/m, and then an image was output to be evaluated according to the above-described image evaluation.

Evaluation results are shown in Table 1.

Example 5

The externally additive-treated toner produced in Example 4 was used.

The toner was loaded in a commercially available color printer (C5800n manufacture by Oki Data Corporation) which was modified by adjusting a spring pressure so that the transfer pressure was a linear pressure of 45N/m, and then an image was output to be evaluated according to the above-described image evaluation.

Evaluation results are shown in Table 1.

Example 6

The externally additive-treated toner produced in Example 4 was used.

The toner was loaded in a commercially available color printer (C5800n manufacture by Oki Data Corporation), which was modified by adjusting a spring pressure so that the transfer pressure was a linear pressure of 60N/m, and then an image was output to be evaluated according to the above-described image evaluation.

Evaluation results are shown in Table 1.

Comparative Example 1

To 100 parts of the base toner prepared as in Example 1, as external additives 3.0 parts of silica particles having a small diameter (R972 by Nippon Aerosil Co., Ltd.) and 0.5 parts of silica particles having a large diameter (UFP-30 by DENKI KAGAKU KOGYO KABUSHIKI KAISHA) were added, and then mixed and stirred together for 5 minutes by a Henschel mixer (FM20 by MITSUI MINING. CO., LTD.) to be subjected to external additive treatment. The obtained toner had an interparticle adhesion force of 300 nN when pressed at 500 nN per particle.

The toner was loaded in a commercially available color printer (C5800n manufacture by Oki Data Corporation), which was modified and adjusted so that the transfer pressure was a linear pressure of 30N/m, and then an image was output to be evaluated according to the above-described image evaluation.

Evaluation results are shown in Table 2.

Comparative Example 2

The externally additive-treated toner produced in Comparative Example 1 was used.

The toner was loaded in a commercially available color printer (C5800n manufacture by Oki Data Corporation), which was modified by adjusting a spring pressure so that the transfer pressure was a linear pressure of 60N/m, and then an image was output to be evaluated according to the above-described image evaluation.

Evaluation results are shown in Table 2.

Comparative Example 3

To 100 parts of the base toner prepared as in Example 1, 1.0 part of silica particles having a small diameter (R972 by Nippon Aerosil Co., Ltd.) was added as an external additive, and then mixed and stirred together for 5 minutes by a Henschel mixer (FM20 by MITSUI MINING. CO., LTD.) to be subjected to external additive treatment. The obtained toner had an interparticle adhesion force of 1,500 nN when pressed at 500 nN per particle.

The toner was loaded in a commercially available color printer (C5800n manufacture by Oki Data Corporation), which was modified and adjusted so that the transfer pressure was a linear pressure of 45N/m, and then an image was output to be evaluated according to the above-described image evaluation.

Evaluation results are shown in Table 2.

Comparative Example 4

The externally additive-treated toner produced in Example 1 was used.

The toner was loaded in a commercially available color printer (C5800n manufacture by Oki Data Corporation), which was modified by adjusting a spring pressure so that the transfer pressure was a linear pressure of 15N/m, and then an image was output to be evaluated according to the above-described image evaluation.

Evaluation results are shown in Table 2.

Comparative Example 5

The externally additive-treated toner produced in Example 1 was used.

The toner was loaded in a commercially available color printer (C5800n manufacture by Oki Data Corporation), which was modified by adjusting a spring pressure so that the transfer pressure was a linear pressure of 80N/m, and then an image was output to be evaluated according to the above-described image evaluation.

Evaluation results are shown in Table 2.

| Comparative Example 6 | |
|---|---|
| Polyester resin A (softening point 131° C., acid value (AV) 25 mgKOH/g) | 68 parts |
| Polyester resin B (softening point 116° C., acid value (AV) 1.9 mgKOH/g) | 32 parts |
| Master batch for cyan (containing 50% by mass of C.I. Pigment Blue 15:3) | 20 parts |
| Carnauba wax | 4 parts |

The above-described toner material was sufficiently mixed by a Henschel mixer, and then the mixture was melted and kneaded by a twin-screw extruder-kneader (PCM-30; by Ikegai Tekko Co., Ltd.), with the discharge port removed therefrom, to obtain a mixture. The mixture was drawn to be a thickness of 2 mm by a cooling press roller, and cooled with a cooling belt, coarsely pulverized with a feather mill, and then pulverized by a mechanical pulverizer, KTM (by Kawasaki Heavy Industries, Ltd.) so as to have a volume average particle diameter of 10 μm to 15 μm. The pulverized mixture was further pulverized and coarsely classified by a jet pulverizer, IDS (by Nippon Pneumatic Mfg. Co., Ltd.), and then minutely classified by a rotor classifier, Teeplex classifier (type 100ATP; by Hosokawa Micron K. K.) to obtain a toner base having a volume average particle diameter of 9.4 μm To 100 parts of the base toner prepared above, as external additives 1.0 part of silica particles treated with a silicone oil (RY200 by Nippon Aerosil Co., Ltd.) and 0.5 parts of silica particles having a large diameter (UFP-30 by DENKI KAGAKU KOGYO KABUSHIKI KAISHA) were added, and then mixed and stirred together for 5 minutes by a Henschel mixer (FM20 by MITSUI MINING. CO., LTD.) to be subjected to external additive treatment. The obtained toner had an interparticle adhesion force of 2,000 nN when pressed at 500 nN per particle.

The toner was loaded in a commercially available color printer (C5800n manufacture by Oki Data Corporation), which was modified and adjusted so that the transfer pressure was a linear pressure of 30N/m, and then an image was output to be evaluated according to the above-described image evaluation.

Evaluation results are shown in Table 2.

Comparative Example 7

The externally additive-treated toner produced in Comparative Example 6 was used.

The toner was loaded in a commercially available color printer (C5800n manufacture by Oki Data Corporation), which was modified by adjusting a spring pressure so that the transfer pressure was a linear pressure of 80N/m, and then an image was output to be evaluated according to the above-described image evaluation.

Evaluation results are shown in Table 2.

TABLE 1

| | Example 1 | Example 2 | Example 3 | Example 4 | Example 5 | Example 6 |
|---|---|---|---|---|---|---|
| Interparticle adhesion force | 600 nN | 600 nN | 600 nN | 980 nN | 980 nN | 980 nN |
| Transfer pressure | 30 N/m | 45 N/m | 60 N/m | 30 N/m | 45 N/m | 60 N/m |
| Change of hue (ΔE) | A | A | A | A | A | A |
| Dropout | A | A | B | A | A | B |

TABLE 2

| | Comp. Ex. 1 | Comp. Ex. 2 | Comp. Ex. 3 | Comp. Ex. 4 | Comp. Ex. 5 | Comp. Ex. 6 | Comp. Ex. 7 |
|---|---|---|---|---|---|---|---|
| Interparticle adhesion force | 300 nN | 300 nN | 1,500 nN | 600 nN | 600 nN | 2,000 nN | 2,000 nN |
| Transfer pressure | 30 N/m | 60 N/m | 45 N/m | 15 N/m | 80 N/m | 30 N/m | 80 N/m |
| Change of hue (ΔE) | C | C | C | A | A | A | A |
| Dropout | A | B | C | C | C | C | C |

From the above evaluation results, Examples 1 to 6 could obtain the high quality images without change of hue and dropout.

On the other hand, Comparative Examples 1 to 5 could not obtain the images evaluated good in all of the change of hue and dropout.

What is claimed is:

1. An image forming method comprising:

charging surfaces of latent electrostatic image bearing members;

exposing the charged surfaces of the latent electrostatic image bearing members so as to form latent electrostatic images corresponding to each color;

developing the latent electrostatic images using developers of four colors so as to form each color toner image; and transferring each toner image from the latent electrostatic image bearing members to an intermediate transfer belt applying a pressure so as to form a color image, wherein during said developing, a toner is used that has an interparticle adhesion force of 500 nN to 1,200 nN when pressed at 500 nN and a volume average particle diameter of 4 μm to 8 μm, and during said transferring, an applied pressure is 20 N/m to 60 N/m, and wherein a tandem image forming apparatus is used in the image forming method.

2. The image forming method according to claim 1, wherein particles of the toner are subjected to external additive treatment with inorganic fine particles treated with silicone oil and inorganic fine particles not treated with silicone oil having an average primary particle diameter of 50 nm to 150 nm.

3. The image forming method according to claim 2, wherein the inorganic fine particles comprise fine particles selected from silica, alumina, titania and a composite oxide thereof.

4. The image forming method according to claim 1, wherein when an applied pressure of "n" th color toner is defined as "P(n)", and an applied pressure of "(n+1)" th color is defined as "P(n+1)", P(n) and P(n+1) satisfy the relation of P(n)>P(n+1) upon transferring the toner image formed on the latent electrostatic image bearing members to the transfer medium.

5. The image forming method according to claim 1, wherein after the toner is transferred to the transfer medium, residual toner remaining on the latent electrostatic image bearing members is recovered in a developing unit for reuse.

6. The image forming method according to claim 1, wherein when the interparticle adhesion force of the toner transferred on the transfer medium as (n) th color is defined as "Ft(n)" and the interparticle adhesion force of the toner transferred on the transfer medium as (n+1)th color is defined as "Ft(n+1)", Ft(n) and Ft(n+1) satisfy the relation of Ft(n)>Ft (n+1).

7. The image forming method according to claim 1, wherein in said transferring, a transfer nip portion applies said pressure, wherein said intermediate transfer belt is pressed by each latent electrostatic image bearing member, and each transfer roller facing each latent electrostatic image bearing member, at said transfer nip portion.

* * * * *